US010265563B2

(12) United States Patent
Miller et al.

(10) Patent No.: US 10,265,563 B2
(45) Date of Patent: Apr. 23, 2019

(54) MULTIPURPOSE FITNESS APPARATUS AND METHOD FOR ASSEMBLY

(71) Applicant: XYSTUS, LLC, Carrollton, TX (US)

(72) Inventors: Reuben A. Miller, McKinney, TX (US); Shane Hernandez, McKinney, TX (US)

(73) Assignee: XYSTUS, LLC, Carrollton, TX (US)

( * ) Notice: Subject to any disclaimer, the term of this patent is extended or adjusted under 35 U.S.C. 154(b) by 0 days.

(21) Appl. No.: 15/480,579

(22) Filed: Apr. 6, 2017

(65) Prior Publication Data

US 2017/0209727 A1 Jul. 27, 2017

Related U.S. Application Data

(63) Continuation of application No. 14/684,626, filed on Apr. 13, 2015, now Pat. No. 9,649,521.

(Continued)

(51) Int. Cl.

*A63B 5/20* (2006.01)
*A61H 15/00* (2006.01)

(Continued)

(52) U.S. Cl.

CPC ... *A63B 21/00043* (2013.01); *A61H 15/0092* (2013.01); *A63B 5/20* (2013.01);

(Continued)

(58) Field of Classification Search

CPC .... A61H 2015/0014; A61H 2015/0021; A61H 2015/0028; A61H 2015/0035; A61H 2015/0057; A61H 15/0092; A61H 2201/1253; A63B 5/20; A63B 17/00; A63B 17/02; A63B 17/04; A63B 21/0004; A63B 21/00043; A63B 21/0552; A63B 21/015; A63B 21/00185; A63B 21/4049;

(Continued)

(56) References Cited

U.S. PATENT DOCUMENTS 3,298,687 A * 1/1967 Douglas ..... A61H 15/0092 482/122
3,415,515 A * 12/1968 Otto ..... A63B 5/20 482/129

(Continued)

FOREIGN PATENT DOCUMENTS

CN 203842248 U 9/2014
CN 104274945 A 1/2015

*Primary Examiner* — Joshua Lee

(74) *Attorney, Agent, or Firm* — Stephen Y. Liu; Samie S. Leigh; Carstens & Cahoon, LLP

(57) ABSTRACT

A fitness apparatus and a method for assembly are disclosed. The fitness apparatus comprises a wheel assembly that includes a first circular side parallel to a second circular side, both bounded by a curved tread. Within the wheel assembly is an enclosable storage chamber. The fitness apparatus also includes an axis perpendicular to the first circular side and the second circular side, and when the fitness apparatus is in an abdominal exercise wheel configuration, at least a portion of the wheel assembly rotates around the axis. The fitness apparatus also includes a centerbore along the axis that supports a first removable handle and a second removable handle when the fitness apparatus is in the abdominal exercise wheel configuration.

18 Claims, 10 Drawing Sheets

Related U.S. Application Data

(60) Provisional application No. 62/000,344, filed on May 19, 2014.

(51) Int. Cl.

| | |
|---|---|
| ***A63B 21/00*** | (2006.01) |
| ***A63B 22/20*** | (2006.01) |
| ***A63B 23/02*** | (2006.01) |
| ***A63B 23/12*** | (2006.01) |
| ***A63B 71/00*** | (2006.01) |
| ***A63B 21/055*** | (2006.01) |
| ***A63B 23/035*** | (2006.01) |
| *A63B 22/00* | (2006.01) |
| *A63B 23/00* | (2006.01) |

(52) U.S. Cl.

CPC ..... *A63B 21/00* (2013.01); *A63B 21/00185* (2013.01); *A63B 21/0552* (2013.01); *A63B 21/4025* (2015.10); *A63B 22/20* (2013.01); *A63B 23/0211* (2013.01); *A63B 23/03525* (2013.01); *A63B 23/03541* (2013.01); *A63B 23/1236* (2013.01); *A63B 71/0036* (2013.01); *A61H 2015/0014* (2013.01); *A61H 2201/1253* (2013.01); *A63B 2022/0035* (2013.01); *A63B 2022/0038* (2013.01); *A63B 2022/0041* (2013.01); *A63B 2023/006* (2013.01); *A63B 2210/00* (2013.01); *A63B 2210/50* (2013.01)

(58) Field of Classification Search

CPC ... A63B 22/0046; A63B 22/20; A63B 22/201; A63B 22/203; A63B 23/02; A63B 23/0205; A63B 23/0211; A63B 23/03525; A63B 2210/50; A63B 71/0036; A63B 2210/00; A63B 2210/58

See application file for complete search history.

(56) References Cited

U.S. PATENT DOCUMENTS 3,428,015 A * 2/1969 Cloud ..... A63B 19/02 280/206
3,905,617 A * 9/1975 Smith ..... A63B 19/02 280/206
4,364,579 A * 12/1982 Fisher ..... A63B 19/02 280/206
4,431,185 A * 2/1984 Cisneros ..... A63B 21/072 220/318
4,722,523 A * 2/1988 Yang ..... A63B 17/04 482/106
5,637,065 A * 6/1997 Chang ..... A63B 23/14 482/1
5,707,325 A * 1/1998 Chiou ..... A63B 22/20 482/127
6,419,650 B1 * 7/2002 Ryan ..... A61H 15/00 601/122
7,175,573 B1 * 2/2007 Huang ..... A63B 21/0004 446/236
8,382,645 B2 * 2/2013 Mylrea ..... A63B 21/0004 482/148
8,894,555 B2 * 11/2014 Colledge ..... A63B 21/0004 482/118
9,005,088 B2 * 4/2015 Sides, Jr. ..... A63B 21/0618 482/106
9,352,184 B2 * 5/2016 Davis ..... A63B 21/0552
2002/0123416 A1 * 9/2002 Huang ..... A63B 21/153 482/140
2005/0059532 A1 * 3/2005 Huang ..... A63B 5/20 482/82
2008/0167168 A1 * 7/2008 Hurst ..... A63B 21/0728 482/132
2008/0179214 A1 * 7/2008 Hall ..... A63B 71/0036 206/579
2008/0200851 A1 * 8/2008 Faussett ..... A61H 15/0092 601/119
2011/0183825 A1 * 7/2011 Yang ..... A63B 21/4039 482/132
2011/0300995 A1 * 12/2011 Castiglione ..... A61H 15/0092 482/51
2012/0065557 A1 * 3/2012 Phillips ..... A61H 15/0092 601/99
2012/0077650 A1 * 3/2012 Amstler ..... A63B 21/0125 482/114
2012/0157274 A1 * 6/2012 MacColl ..... A63B 21/0004 482/132
2012/0264578 A1 * 10/2012 Frederick ..... A63B 21/0004 482/132
2012/0309599 A1 * 12/2012 Miller, Jr. ..... A63B 22/20 482/139
2013/0138024 A1 * 5/2013 Jennings ..... A61H 15/0092 601/119
2013/0178768 A1 * 7/2013 Dalebout ..... A61H 15/0092 601/46
2013/0252791 A1 9/2013 Chang
2013/0310234 A1 * 11/2013 Miller, Jr. ..... A63B 22/20 482/139
2014/0128786 A1 * 5/2014 Ross ..... A61H 15/0092 601/118
2014/0342883 A1 * 11/2014 Joost ..... A63B 21/0442 482/129
2015/0209220 A1 * 7/2015 Lin ..... A61H 15/0092 601/119
2016/0045782 A1 2/2016 Wong

* cited by examiner

MULTIPURPOSE FITNESS APPARATUS AND METHOD FOR ASSEMBLY

CROSS-REFERENCE TO RELATED APPLICATION

This application is a continuation patent application of co-pending U.S. patent application Ser. No. 14/684,626 entitled "Multipurpose Fitness Apparatus and Method for Assembly" filed Apr. 13, 2015, the technical disclosure of which is hereby incorporated by reference in its entirety.

BACKGROUND OF THE INVENTION

Technical Field

The present invention relates to an apparatus for a compact, multi-purpose fitness device having an abdominal exercise wheel configuration in one aspect, and a method for assembling and disassembling the same.

Description of Related Art

A pervading theme in American society is health and wellness, one such component of which is fitness. Fit people are less likely to be obese, which reduces the risk being afflicted with a number of health-related maladies, such as heart disease, stroke, high blood pressure, and diabetes. Studies have shown a number of psychological and cognitive benefits as well. As a result, fit people also tend to live longer.

Exercising promotes fitness. Currently, the Centers for Disease Control and Prevention recommends that adults strive for at least 150 minutes of moderate-intensity aerobic activity and muscle-strengthening activities each week. Many Americans fall woefully short. As people age, lifestyles tend to become more sedentary. School activities and hobbies are replaced by long commutes and jobs that may require hours spent seated in front of a computer monitor. After school sports and extracurricular activities are replaced by evenings in front of a television, and nights out in restaurants and bars. Decreased activity levels may also be the result of a lack of access to fitness equipment. Home gyms require a large capital investment, and oftentimes trips to the local gym require more of a daily time investment than is available. In addition, employees that travel for work may not be geographically proximate to a workout facility.

BRIEF SUMMARY OF THE INVENTION

At least one solution to the aforementioned problems is a fitness apparatus that is relatively inexpensive, easy to use, easy to store, and provides a variety of proven, time-tested exercises. To this end, Applicant has devised a novel way of incorporating various pieces of fitness equipment into a form factor characterized by portability, storability, and usability.

The fitness apparatus generally includes a wheel assembly that has a first circular side and a second circular side that is opposite the first circular side. In addition, the wheel assembly includes a curved tread surface around a circumference of the first and second circular sides. The fitness apparatus also includes an enclosable storage chamber within the wheel assembly. Further, when in an abdominal wheel configuration, the fitness apparatus includes an axis perpendicular to the first and second circular sides, around which at least a portion of the wheel assembly rotates, relative to the axis. Finally, in the abdominal wheel configuration, the fitness apparatus includes a first removable handle that projects perpendicularly from the first circular side, and a second removable handle that projects perpendicularly from the second circular side. The pair of removable handles projects outwardly along the axis.

In a first embodiment, removal of the wheel assembly transforms the fitness apparatus from the abdominal wheel configuration into the massage bar configuration that can be used to relieve muscle tension and knotting. Further, removal of the handles from the massage bar enables attachment of the pair of handles to a rope to form a jump rope that can provide an aerobic workout. Thus, in accordance with a first aspect of this first embodiment, a fitness apparatus is provided that includes a shaft, a foam roller rotatably engaged around an outer surface of the shaft, and a wheel assembly having a centerbore through which the shaft and the foam roller are partially introduced. In addition, the wheel assembly is securely engaged around the foam roller to allow the wheel assembly to rotate axially around the shaft while maintaining a fixed position relative to the foam roller. The fitness apparatus also includes one or more resistance bands and a set of sliders that can be stored within the storage chamber along with the jumping rope.

A second aspect of the first embodiment provides a method of assembling a fitness apparatus having an abdominal exercise wheel configuration, a massage bar configuration, and a jump rope configuration. The steps of the method comprise introducing a second end of a shaft comprising a foam roller rotatably engaged thereon through a centerbore of a wheel assembly, wherein the shaft comprises a first handle located at a first end. The wheel assembly is then positioned substantially centrally on the foam roller, and a second handle is affixed to the second end of the shaft.

In a second embodiment, the fitness apparatus is designed so that the various pieces of fitness equipment can be used simultaneously by a plurality of users, or by a single user in rapid succession without the need for interrupting a workout for assembly. Such a characteristic is preferable for circuit training. In addition, this second embodiment is also characterized by a compact form factor in a stored configuration to facilitate portability and storability. Thus, in accordance with a first aspect of this second embodiment, a fitness apparatus is provided that includes a wheel assembly having a stationary rim around which a curved tread surface rotates. Coupled to the rim is a reinforced connection for attachment with a pair of removable handles that are affixed to the fitness apparatus at the reinforced connection. In addition, one or more removable covers may be provided to enclose or expose a storage chamber within the wheel assembly. The storage chamber may house a set of resistance bands, a set of sliders, and/or a jump rope.

A second aspect of the second embodiment provides a method of disassembling a fitness apparatus having a wheel assembly including a stationary rim around which a curved tread surface rotates. The steps of the method include removing at least one handle of a pair of removable handles, exposing a storage chamber within the wheel assembly, and placing the at least one handle of the pair of removable handles into the storage chamber. Optionally, the method may include the step of storing within the storage chamber a set of resistance bands, a set of sliders, and/or a jump rope. Thereafter, the storage chamber is resealed.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all or at least a subset of figures.

Figure 1:
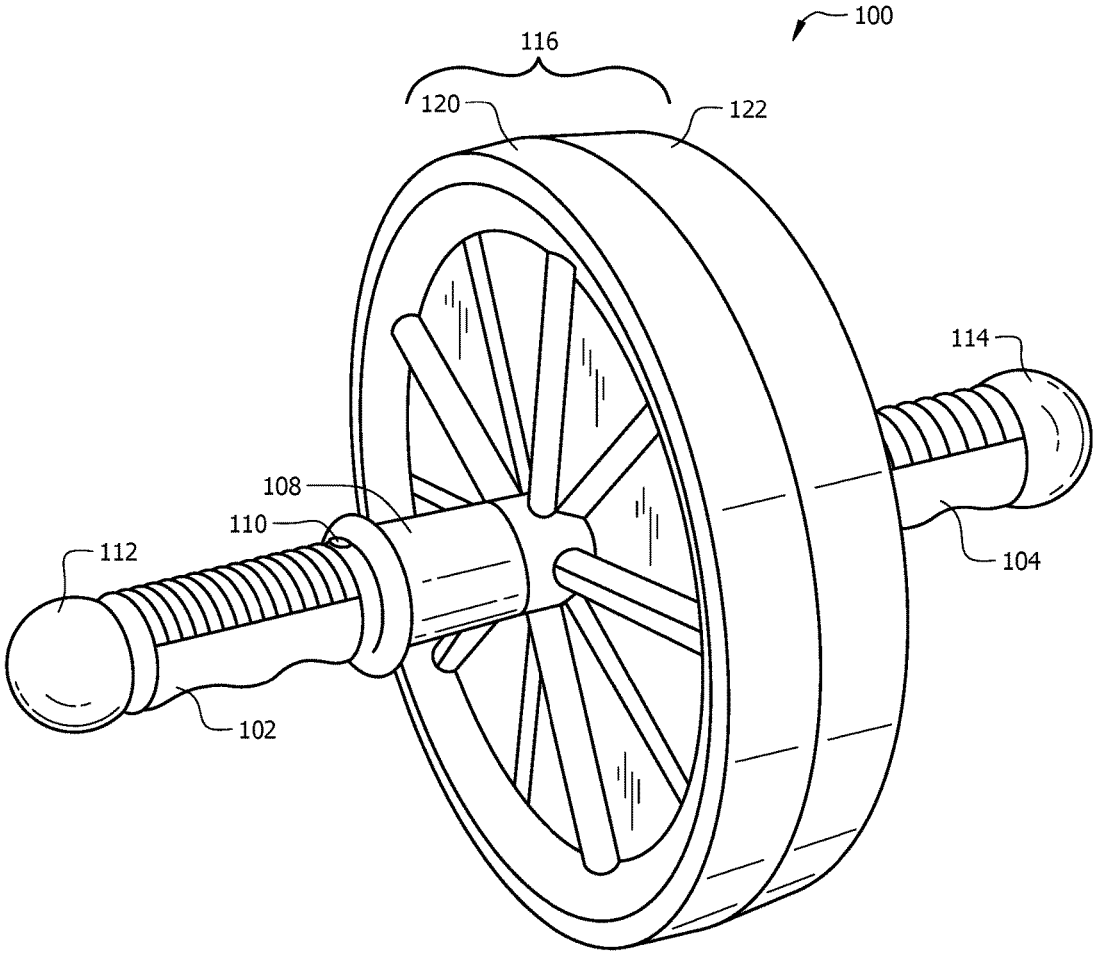
FIG. 1 is a perspective view of the fitness apparatus in accordance with an illustrative embodiment.

FIG. 1 is a perspective view of the fitness apparatus in accordance with an illustrative embodiment. In particular, fitness apparatus 100 is depicted in the assembled configuration which may also be referred to herein as the abdominal exercise wheel configuration. Fitness apparatus 100 can be generally described as a shaft with opposing handles on each end and a wheel assembly located between the handles and rotatably engaged around the shaft. In particular, handles 102 and 104 are removably engaged to opposite ends of shaft 106 (shown in FIG. 2), and foam roller 108 is rotatably engaged around an outer surface of shaft 106, between handles 102 and 104. Also located between handles 102 and 104 is wheel assembly 116, which is also configured to rotate around shaft 106.

Foam roller 108 is a hollow cylindrical component that has a soft outer surface selected of a material that can be used to comfortably engage a user's body for serving as a massage bar. In a non-limiting embodiment, the outer surface of foam roller 108 is made of a soft and spongy foam; however, alternate embodiments may have an outer surface formed from material having similar characteristics. The inside surface of foam roller 108, which engages the outer surface of shaft 106, has a coefficient of friction that allows foam roller 108 to easily rotate around the outer surface of shaft 106.

In the illustrative example in FIG. 1, foam roller 108 is secured to shaft 106 by handles 102 and 104 which act similar to bookends. Removal of handle 104, for example, would allow foam roller 108 to be removed from shaft 106. This configuration that permits easy disassembly that facilitates cleaning and maintenance of fitness apparatus 100. However, in an alternate embodiment, foam roller 108 may be permanently positioned on shaft 106 by a pair of guides (not shown) protruding from shaft 106 and located on each end of foam roller 108 that prevents lateral movement of foam roller 108 on shaft 106.

As already mentioned, pair of handles 102 and 104 is removably engaged to opposite ends of shaft 106. Pair of handles 102 and 104 may be attached to shaft 106 using any currently existing or later developed attachment mechanism. For example, in a non-limiting example, handles 102 and 104 may be include female threading and shaft 106 may include male threading so that the handles 102 and 104 may be screwed onto shaft 106. As used herein, the term threaded and counter-threaded may be substituted to emphasize the generality of the attachment mechanism and that any combination of threading may be implemented that permits the attachment of handles 102 and 104 to shaft 106. However, in the illustrative embodiment depicted in FIG. 1, pair of handles 102 and 104 is attached to shaft 106 using a quick-release mechanism that allows handles 102 and 104 to be removed from shaft 106 when set of protrusions 110 is depressed. Additional detail regarding the operation of set of protrusions 110 will be provided with respect to the discussion of FIGS. 3 and 4.

Pair of handles 102 and 104 is configured with a rounded endcaps 112 and 114, respectively. Rounded endcaps 112 and 114 are sized and shaped to serve as a tool for engaging muscle trigger points. In one example, handle 102 and rounded endcap 112 are removed from shaft 106, permitting a user to grasp handle 102 such that rounded endcap 112 may be used to massage a muscle. In another example, additional leverage may be obtained by causing rounded endcap 112 to engage a muscle while handle 102 is still attached to shaft 106 and fitness apparatus 100 is in the massage bar configuration.

Wheel assembly 116 is a wheel-shaped component having a centerbore 118 (depicted in FIG. 2) that forms a passage from a first lateral side of wheel assembly 116 to a second lateral side of wheel assembly 116. In the abdominal exercise wheel configuration, centerbore 118 is designed to receive foam roller 108, which is in turn rotatably engaged around shaft 106. Additionally, centerbore 118 is sized so that wheel assembly 116 snugly engages the outer surface of foam roller 108 when in the abdominal exercise wheel configuration. Thus the rotation of foam roller 108 around shaft 106 also allows wheel assembly 116 to rotate around an axis formed by shaft 106. Restated, in the illustrative embodiment of FIG. 1, wheel assembly 116 rotates relative to shaft 106 but does not rotate relative to foam roller 108.

Wheel assembly 116 depicted in FIG. 1 is formed from first component 120 and second component 122 joined together. The first and second components 120 and 122 may be joined together using any currently existing or later developed means. For example, first component 120 may be threaded and second component 122 may be counter-threaded so that the two parts can be screwed together to form wheel assembly 116. Separating first component 120 from second component 122 exposes a chamber (shown in FIG. 2) within wheel assembly 116. Although wheel assembly 116 depicted in this non-limiting embodiment is formed from two substantially equivalent halves, in an alternate embodiment, first component 120 and second component 122 may have unequal or disproportionate sizes. For example, first component 120 may include a first lateral side of wheel assembly 116 and also the entirety of the curved tread surface that engages a floor. Second component 122 would then comprise only a second lateral side, or a portion of the second lateral side of wheel assembly 116. Thus, in this alternate embodiment, the second lateral side may form a detachable cover permitting access to the chamber within.

The outer, curved portion of first component 120 and second component 122 form a curved tread surface that engages an exercising surface. The curved tread surface may be formed from a material that is capable of frictionally engaging a flooring surface upon which fitness apparatus 100 is being used. Thus, the outer portion of the curved tread surface may be formed from rubber, or a rubber-like product that can be used equally well on carpet, hardwood, tile, or other flooring material. In the alternative or in addition, the outer portion of the curved tread surface may include features, such as tread marks in any number of different configurations, which promote adhesion of the curved tread surface on the flooring material.

Figure 2:
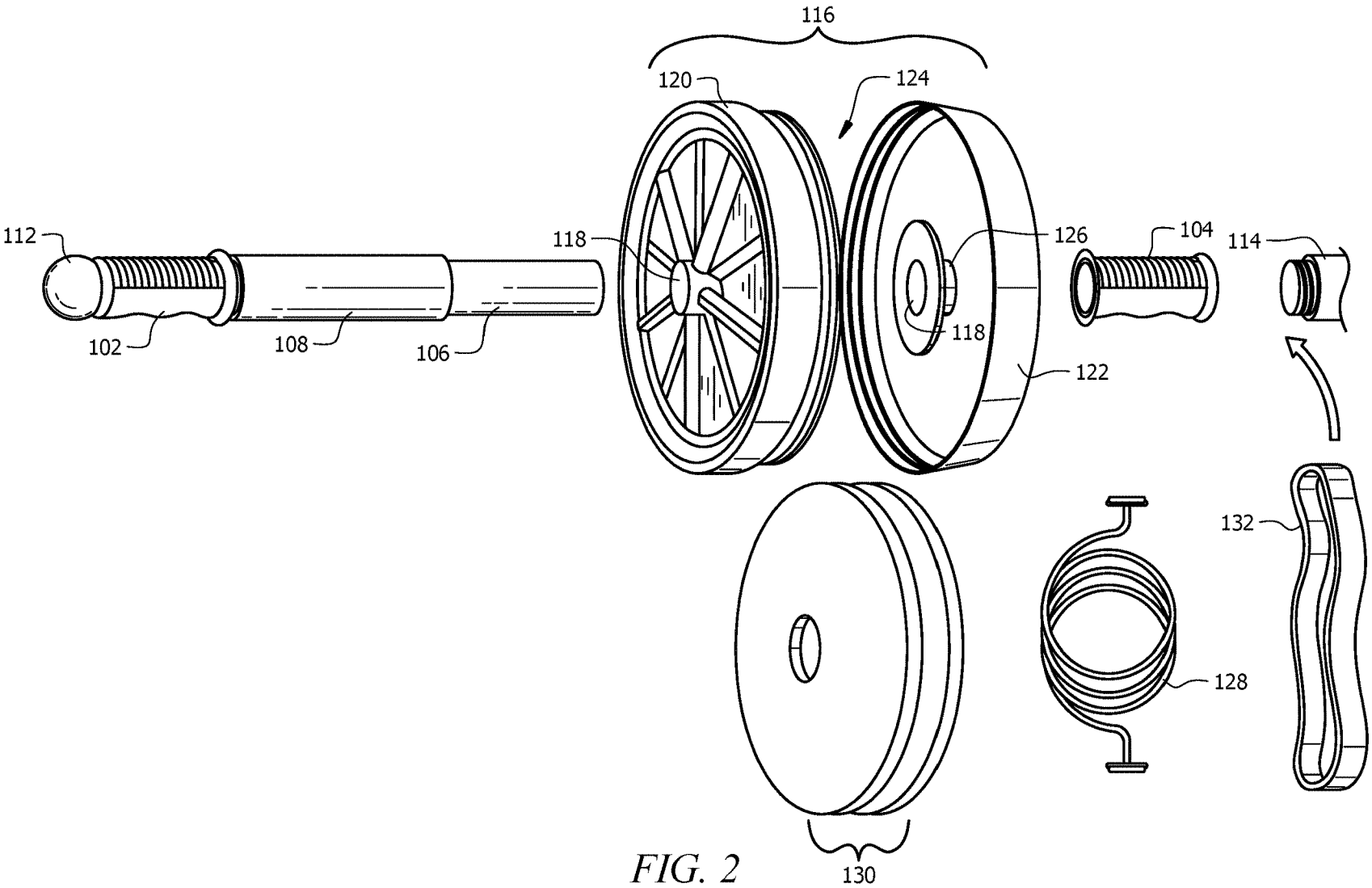
FIG. 2 is an expanded view of the fitness apparatus in accordance with an illustrative embodiment.

FIG. 2 is an exploded view of the components that form fitness apparatus 100. Handle 102, which is depicted as attached to shaft 106, includes rounded endcap 112. Foam roller 108 is placed around shaft 106 and positioned against handle 102. The inside diameter of foam roller 108 is sized slightly larger than the outer diameter of shaft 106 so that it can easily rotate around shaft 106. Furthermore, foam roller 108 may be slidably disengaged from shaft 106 by moving it laterally in a direction opposite of handle 104.

First component 120 and second component 122 of wheel assembly 116 are shown separately to depict storage chamber 124 located within wheel assembly 116. In this illustrative embodiment in FIG. 2, first component 120 and second component 122 are depicted with opposing threads so that they can be screwed together to form wheel assembly 116. In addition, within storage chamber 124 is spindle 126, which is shown attached to second component 122, projecting outwardly from an interior surface of second component 122. Spindle 126 is positioned so that centerbore 118 can pass from a first lateral side of first component 120 to the opposite lateral side of second component 122 through spindle 126 when the two components of wheel assembly 116 are joined. Spindle 126 is sized, in part, to accommodate rope 128. Thus, the height of spindle 126 is sufficient to accommodate the entire length of rope 128 when in the coiled arrangement within storage chamber 124.

Spindle 126 of FIG. 2 is depicted with a flange. The flange provides a convenient means of compartmentalizing storage chamber 124. For example, rope 124 may be stored in the part of storage chamber 124 located beneath the flange. In addition, set of sliders 130 may be stored within storage chamber 124 in the part above the flange. Set of sliders 130 is one or more disc-shaped pieces of exercise equipment that reduces friction and facilitates exercise routines that rely on body weight. In a non-limiting embodiment, a first side of set of sliders 130 has a surface adapted for engaging a carpeted floor. The opposite side may be adapted for engaging a hard flooring surface, such as tile or hardwood. At the center of set of sliders 130 is a hole that aligns with centerbore 118 of wheel assembly 116 for accommodating shaft 106. Consequently, when set of sliders 130 are placed within storage chamber 124 and properly aligned, shaft 106 and foam roller 108 may pass at least partially through centerbore 118 to form the abdominal exercise wheel configuration.

Detached handle 104 shown in FIG. 2 is depicted with the endcap 114 removed, exposing a chamber located therein. Resistance band 132 may be stored within the chamber located inside handle 104. In this illustrative embodiment, endcap 114 and handle 104 are counter-threaded so that endcap 114 can be screwed on to handle 104. However, in alternate embodiments, other attachment means may be implemented. Although resistance band 132 is depicted as being stored within the chamber of handle 104, resistance band 132 may also be stored within storage chamber 124.

To assemble fitness apparatus 100 from the constituent parts shown in FIG. 2, the following general steps may be taken. Storage cavities provided within fitness apparatus 100 should be packed. For example, one or more resistance bands may be packed within handles 102 and 104 and the corresponding endcaps replaced. Rope 128 may be wound around spindle 126, and set of sliders 130 placed within storage chamber 124 so that centerbore 118 is unobstructed. Thereafter, first component 120 and second component 122 are screwed together to form wheel assembly 116.

A handle, such as handle 102 may be affixed to shaft 106. Foam roller 108 can then be positioned on shaft 106 buttressed against handle 102. Shaft 106 and foam roller 108 may then be introduced into centerbore 118 of wheel assembly 116 and positioned such that wheel assembly 116 is located substantially centrally on shaft 106 and foam roller 108. The remaining handle may then be attached to shaft 106, forming the abdominal exercise wheel configuration of fitness apparatus 100.

Figure 3:
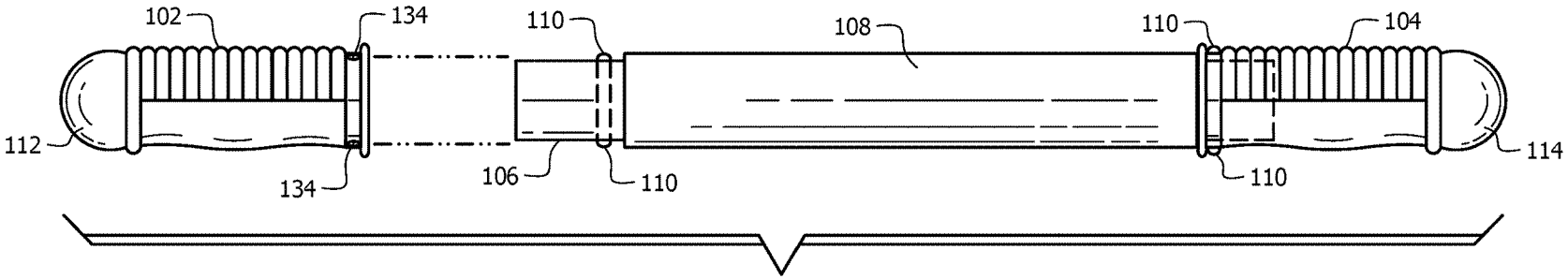
FIG. 3 is a perspective view of a massage bar that can be formed using the component parts of the fitness apparatus.

FIG. 3 is a perspective view of fitness apparatus 100 in a massage bar configuration, which comprises pair of handles 102 and 104 on opposing ends of shaft 106 and foam roller 108 located in between. In this example of FIG. 3, handle 102 is shown as detached from shaft 106 to illustrate the operation of a quick release mechanism for attaching handle 102 to shaft 106. In particular, set of projections 110 are provided which protrude from a surface of shaft 106 and align with anchor holes 134 in handles 102. Depressing set of projections 110 so that the upper surface of set of projections 110 is substantially flush with shaft 106 enables the removal of handles 102 and 104 from shaft 106. Likewise, handle 102 can be reattached to shaft 106 by depressing set of projections 110 while handle 102 is advanced partway down shaft 106 until set of projections 110 occupy anchor holes 134.

Figure 4:
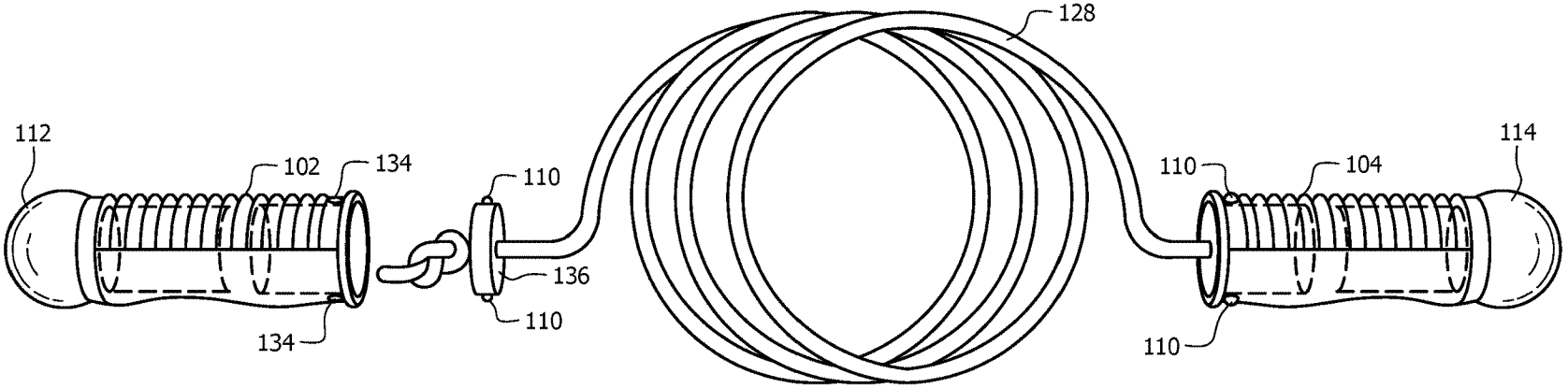
FIG. 4 is an example of a jump rope that can be formed using the parts of the fitness apparatus.

FIG. 4 is an illustrative embodiment depicting fitness apparatus 100 in the jump rope configuration. Jump rope 400 is formed from rope 128, which may be provided with a locking disc 136 on each end. Each of the locking discs 136 includes set of projections 110 that operate in the same manner as described with respect to FIG. 3. Specifically, the set of projections 110 engage anchor holes 134 within handles 102 and 104, providing a universal means of connection so that handles 102 and 104 can be used to achieve both the ab wheel configuration and jump rope configuration of fitness apparatus 100. Locking discs 136 may be temporarily or permanently affixed to the ends of rope 128 and sized to fit within handles 102 and 104. In the example depicted in FIG. 4, locking discs 136 are removably attached to rope 128 by threading and end of rope 128 through a hole in locking disc 136 and tying a simple knot at the end.

To reduce the number of constituent parts of fitness apparatus 100, locking discs 136 of FIG. 4 may be extracted from shaft 106 and attached to the ends of rope 128 to engage handles 102 and 104 every time the jump rope is used. However, in alternate embodiments, rope 128 and shaft 106 may each be provided with a pair of locking discs 136.

Figure 5:
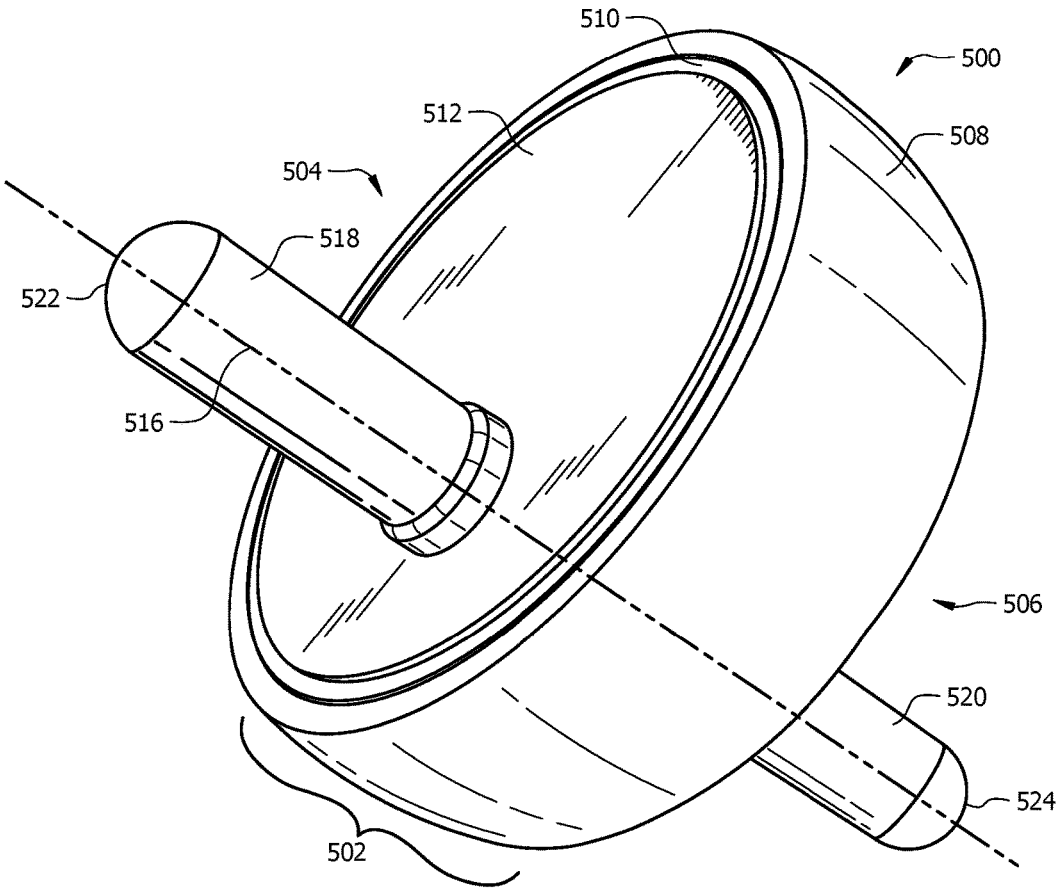
FIG. 5 is a perspective view of the fitness apparatus in accordance with a second illustrative embodiment.

FIG. 5 is a perspective view of the fitness apparatus in an abdominal exercise wheel configuration in accordance with a second illustrative embodiment. Fitness apparatus 500 can be generally described as an abdominal exercise wheel formed from a wheel assembly having a pair of handles projecting perpendicularly from each side.

With particular reference to FIG. 5, fitness apparatus 500 includes wheel assembly 502 that has first circular side 504 and second circular side 506 opposite and parallel to first circular side 504. Around a perimeter of both first circular side 504 and second circular side 506 is curved tread surface 508 engaged around an outer surface of rim 510. In addition, affixed to at least one side of wheel assembly 502 is a removable cover that can be disengaged from fitness apparatus 500 to expose a storage chamber therein. In the illustrative example of FIG. 5, removable cover 512 is removably attached to first circular side 504. Removing removable cover 512 exposes storage cavity 526, which is depicted in more detail in FIG. 6.

Fitness apparatus 500 also includes a pair of handles that extend perpendicularly from each of the circular faces along axis 516. Specifically, removable handle 518 extends outwardly from the first circular side 504, and removable handle 520 extends outwardly from second circular side 506. Each removable handle includes a rounded endcap that can be used for massage therapy. Thus, removable handle 518 includes rounded endcap 522 and removable handle 520 includes rounded endcap 524.

In the illustrative embodiment of FIG. 5, curved tread surface 508 is rotatably engaged around an outer surface of rim 510. Rotation of curved tread surface 508 around rim 510 can be achieved by any currently existing or later developed means. For example, in one non-limiting embodiment, a plurality of ball bearings may be placed between the outer surface of rim 510 and the inner surface of curved tread surface 508 to facilitate movement of the two surfaces relative to one another. In another embodiment lacking the use of ball bearings, the outer surface of rim 510 and the inner surface of curved tread surface 508 may be formed from materials having a coefficient of friction that permits curved tread surface 508 to rotate freely around rim 510. An optional lubricant can also be placed between the two surfaces to promote unimpeded movement.

The outer portion of curved tread surface 508 may be formed from a material that is capable of frictionally engaging a flooring surface upon which fitness apparatus 500 is being used. Thus, the outer portion of curved tread surface 508 may be formed from rubber, or a rubber-like product that can be used equally well on carpet, hardwood, tile, or other flooring material. In the alternative or in addition, the outer portion of curved tread surface 508 may include features, such as tread marks in any number of different configurations, which promote adhesion of curved tread surface 508 on the flooring material. For example, the tread marks may be in the form of split treads that separate curved tread surface 508 into a right side and a left side.

During operation, at least a part of wheel assembly 502 rotates around axis 516, and also pair of removable handles 518 and 520 which are located along axis 516. In particular, and consistent with the embodiment depicted in FIG. 5, the operation of fitness apparatus 500 causes curved tread surface 508 to rotate around rim 510, thus allowing pair of handles 518 and 520 and rim 510 to remain stationary relative to curved tread surface 508.

Figure 6:
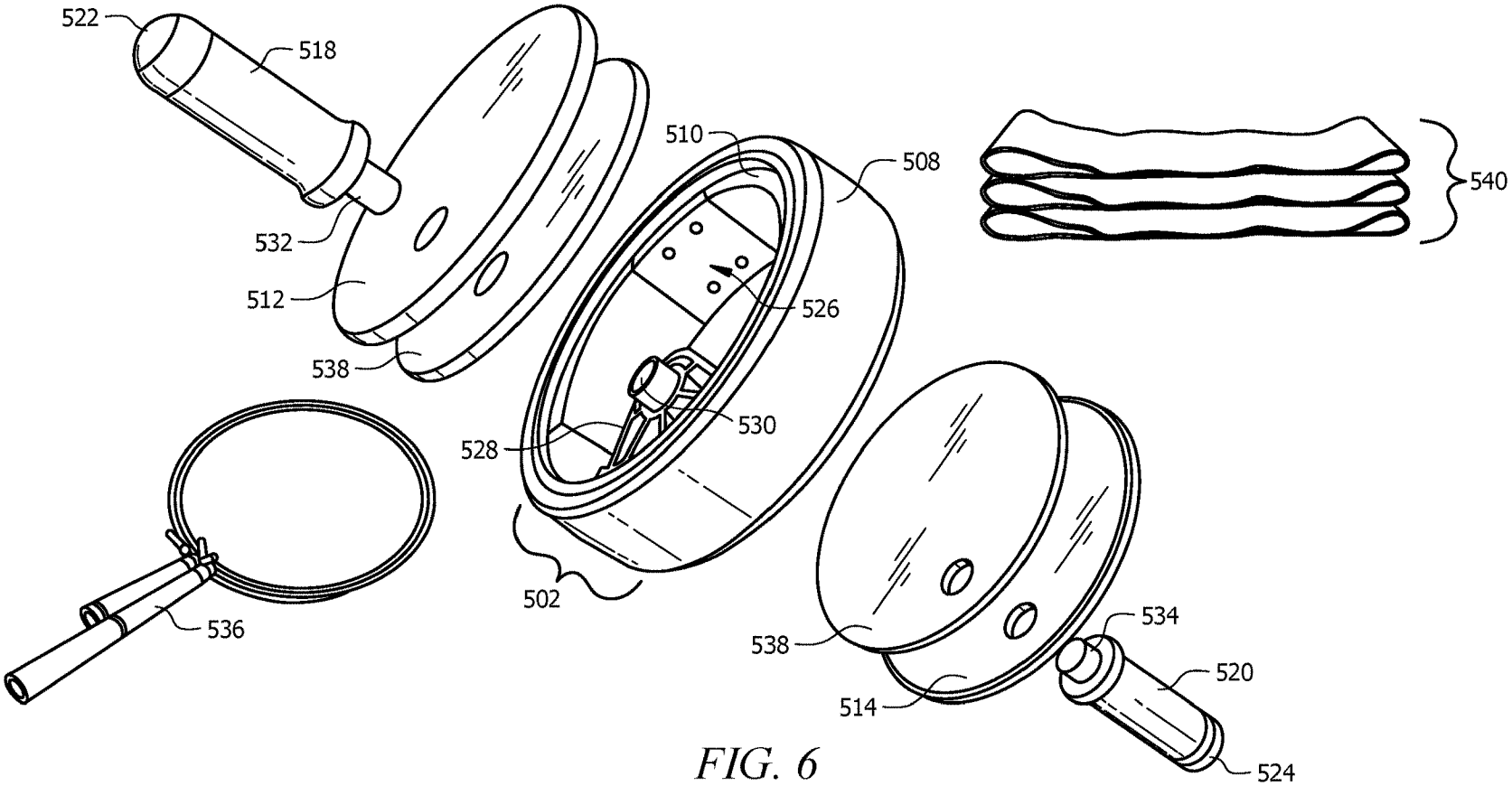
FIG. 6 is an expanded view of the fitness apparatus in accordance with the second illustrative embodiment.

FIG. 6 is an expanded view of fitness apparatus 500 depicted in FIG. 5. Removable handle 518 and removable handle 520 are shown separated from wheel assembly 502, which permits separation of removable covers 512 and 514 from wheel assembly 502 to expose storage chamber 526.

As already mentioned, wheel assembly 502 is a wheel-shaped component of fitness apparatus 500 which includes curved tread surface 508 that is rotatably engaged around rim 510. Affixed to an inner surface of rim 510 is reinforced connection 528 that projects radially inward and has a cross-sectional shape that can be generally described as triangular. However, in alternate embodiments reinforced connection 528 may have a different cross-section shape, such as a circle. Further, in this non-limiting example of FIG. 6, reinforced connection 528 includes centerbore 530 that passes from a first lateral side of reinforced connection 528 to a second lateral side. In an alternate embodiment, rather than passing entirely through reinforced connection 528, centerbore 530 is one of two cavities, one passing partially through the first side of reinforced connection 528 and the other passing partially through the second side of reinforced connection 528 to accommodate at least a part of removable handle 518 and removable handle 520, respectively.

Wheel assembly 502 includes a pair of removable covers, removable cover 512 and removable cover 514. The pair of removable covers 512 and 514 can be attached to the first and second circular sides 504 and 506 of wheel assembly 502 to enclose storage chamber 526. In addition, removable cover 512 and 514 each include a hole that extends centerbore 530 and allows the pair of removable handles 518 and 520 to be inserted within centerbore 530 when removable covers 512 and 514 are attached to wheel assembly 502.

Each of the handles that form the pair of removable handles 518 and 520 include rounded endcaps 522 and 524. In addition, removable handles 518 and 520 include handle extensions 532 and 534 respectively, each of which are sized to engage centerbore 530 and pass at least partially through centerbore 530. Although removable handles 518 and 520 are depicted as having handle extensions 532 and 534 for the purpose of affixing the pair of removable handles 518 and 520 to wheel assembly 502, any currently existing or later developed means may be used to attach removable handles 518 and 520 to wheel assembly 502. Thus, in another embodiment, removable handles 518 and 520 may lack handle extensions 532 and 534 but be outfitted with other types of fasteners.

Various pieces of fitness equipment can be stored within storage chamber 526, including but not limited to jump rope 536, set of sliders 538, and set of resistance bands 540. To make use of the limited amount of space within storage chamber 526, jump rope 536 is configured with telescopic handles that can extend when in use and collapse when stored. Set of resistance bands 540 can be folded and easily placed within storage chamber 526. Further, in this illustrative embodiment of FIG. 6, set of sliders 538 is adapted to fit within storage chamber 526, against removable covers 512 and 514. Set of sliders 538 may include a hole located in a position that permits the pair of removable handles 518 and 520 to be inserted into centerbore 530.

Figure 7:
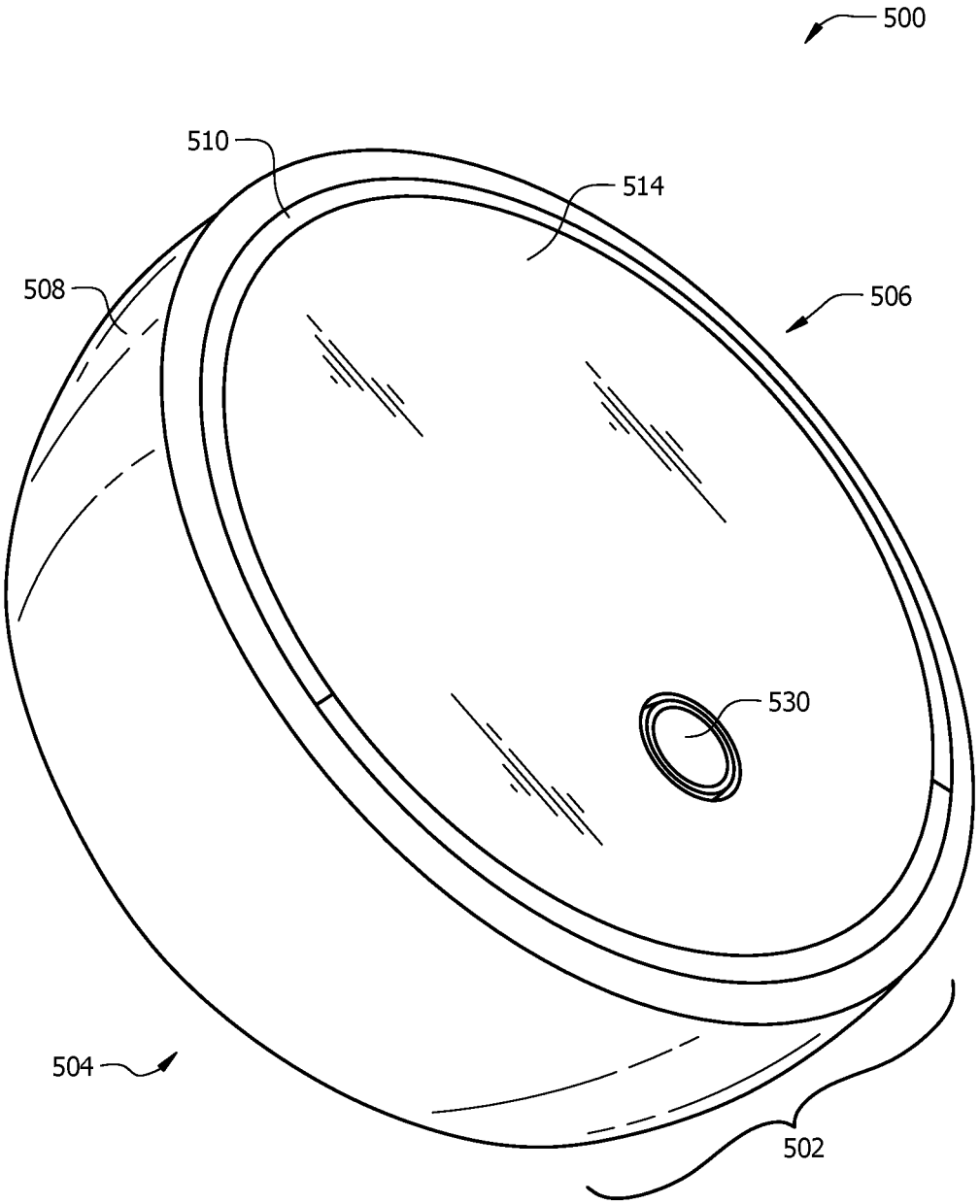
FIG. 7 is a perspective view of the fitness apparatus depicted in FIG. 5 in a storage configuration according to the second illustrative embodiment.

In an illustrative example, to transform fitness apparatus 500 from the abdominal wheel configuration to the storage configuration depicted in FIG. 7, each of the pair of removable handles 518 and 520 is removed from centerbore 530 of wheel assembly 502. If all pieces of fitness equipment have been previously extracted from storage chamber 526, then both removable covers 512 and 514 are disengaged from wheel assembly 502. A first slider in set of sliders 540 is placed against an interior surface of removable cover 512, and removable cover 512 is then reattached to first circular side 504 of wheel assembly 502.

Once removable cover 512 has been attached to first circular side 504 of wheel assembly 502, set of resistance bands 540 and jump rope 536 may be placed within the partially closed storage chamber 526 along with the pair of removable handles 518 and 520. The remaining slider in set of sliders 540 is placed over the opening of storage chamber 526, and removable cover 514 is affixed to the second circular side 506 of wheel assembly 502.

FIG. 7 is a perspective view of fitness apparatus 500 in a storage configuration according to the second illustrative embodiment. As with the illustration of fitness apparatus 500 in FIG. 5, fitness apparatus 500 in FIG. 7 depicts first circular side 504 opposite to and parallel with second circular side 506. Pair of removable handles 518 and 520 have been removed and placed within storage chamber 526 (not shown), along with one or more optional pieces of fitness equipment that may include a set of sliders, a set of resistance bands, and a jump rope. Removable cover 514 encloses storage chamber 526 and prevents the various pieces of fitness equipment from being separated and lost.

As previously discussed, centerbore 530 may form a channel that passes entirely through wheel assembly 502 from first circular side 504 to second circular side 506 along axis 516. Alternatively, centerbore 530 may take the form of a pair of cavities that passes only partially through each side of wheel assembly 502 with depths sufficient to receive handle extensions 532 and 534. Thus, with reference to FIG. 7, centerbore 530 may be a cavity with an opening at second circular side 506 which passes less than half-way through wheel assembly 502. Additionally, centerbore 530 may include another cavity with an opening at first circular side 504 which also passes less than half-way through wheel assembly 502.

In an illustrative example, to transform fitness apparatus 500 from the storage configuration depicted in FIG. 7 to the abdominal exercise wheel configuration depicted in FIG. 5, at least one removable cover is removed from wheel assembly 502 to expose storage chamber 526. Optionally, both removable covers may be removed from wheel assembly 502. Thereafter, the contents within storage chamber 526 are extracted. The user may then elect operate fitness apparatus 500 in the abdominal wheel configuration with the removable covers affixed to wheel assembly 502, or with the removable covers separate from wheel assembly 502. If the user elects to operate fitness apparatus 500 with the removable covers affixed to wheel assembly 502, then the user replaces one or both removable covers 512 and/or 514, making certain to align the holes in each of the respective removable covers with centerbore 530. The pair of removable handles 518 and 520 may then be attached to wheel assembly 502 by inserting handle extensions 532 and 534 into centerbore 530. If the user decides to operate fitness apparatus 500 with removable covers 512 and 514 separated from wheel assembly 502, then the user may remove the other removable cover if it was not previously removed, then the pair of handles 518 and 520 may be attached to wheel assembly 502 by inserting handle extensions 532 and 534 into centerbore 530.

Figure 8A:
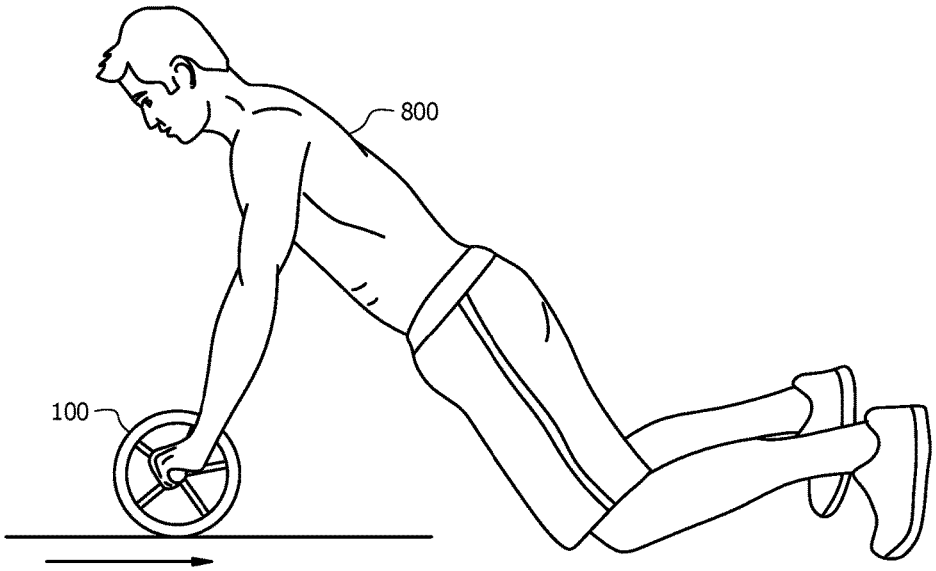
FIGS. 8*a* and 8*b* depicts a user operating fitness apparatus 100 in the abdominal exercise wheel configuration.
Figure 8B:
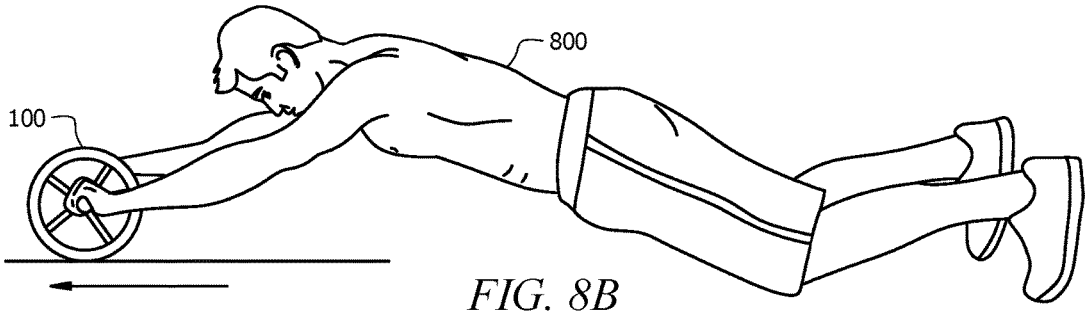

FIGS. 8*a* and 8*b* depicts a user operating fitness apparatus 100 in the abdominal exercise wheel configuration. FIG. 8*a* shows a user in a typical starting position. As can be seen, user 800 grasps handles 102 and 104, distributing weight between the knees of user 800 and fitness apparatus 100. While maintaining the position of the knees, user 800 allows fitness apparatus 100 to roll away until the extended position of FIG. 8*b* is achieved. User 800 then engages core muscles to withdraw fitness apparatus 100 to the starting position of FIG. 8*a*.

Figure 9:
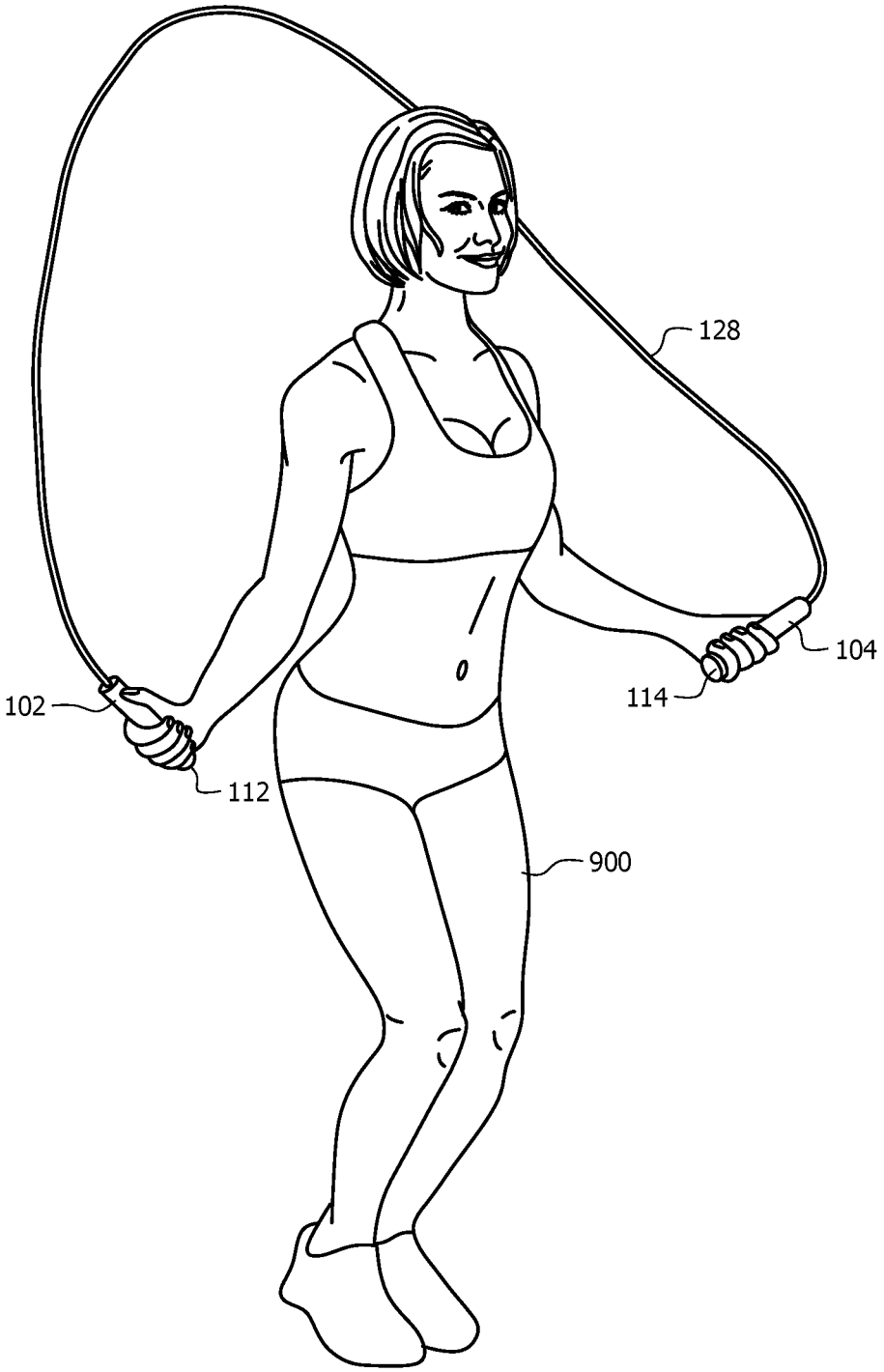
FIG. 9 is shows a user operating a fitness apparatus in the jump rope configuration according to an illustrative embodiment.

FIG. 9 shows a user operating fitness apparatus 100 in the jump rope configuration. As already described above, handles 102 and 104 are attached to the ends of rope 128 by means of locking discs 136 to form jump rope 400. By grasping handles 102 and 104, the user can cause jump rope 400 to rotate in a large arc. As the rope approaches the feet of user 900 during its revolution, user 900 jumps over the rope. The process is repeated to achieve an aerobic workout.

Figure 10:
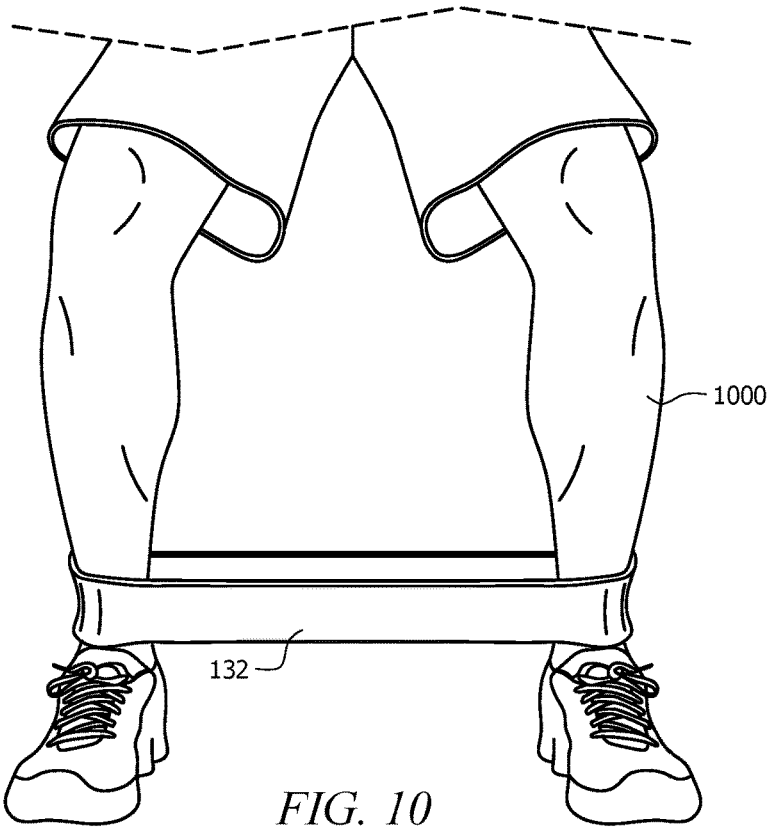
FIG. 10 is depicts a user performing an exercise with the resistance bands in accordance with an illustrative embodiment.

FIG. 10 shows user 1000 using resistance band 132 according to one illustrative embodiment. In particular, user 1000 steps into resistance band 132 so that each leg engages opposite ends of resistance band 132. User 1000 can then perform a sidestep motion against resistance provided by resistance band 132. Although FIG. 10 depicts only one exercise, resistance band 132 may be used with any form of resistance-based exercise. For example, resistance band 132 may be looped around door handles to effectuate a modified rowing exercise, or grasped in each hand and pulled apart to exercise back and shoulder muscles.

Figure 11:
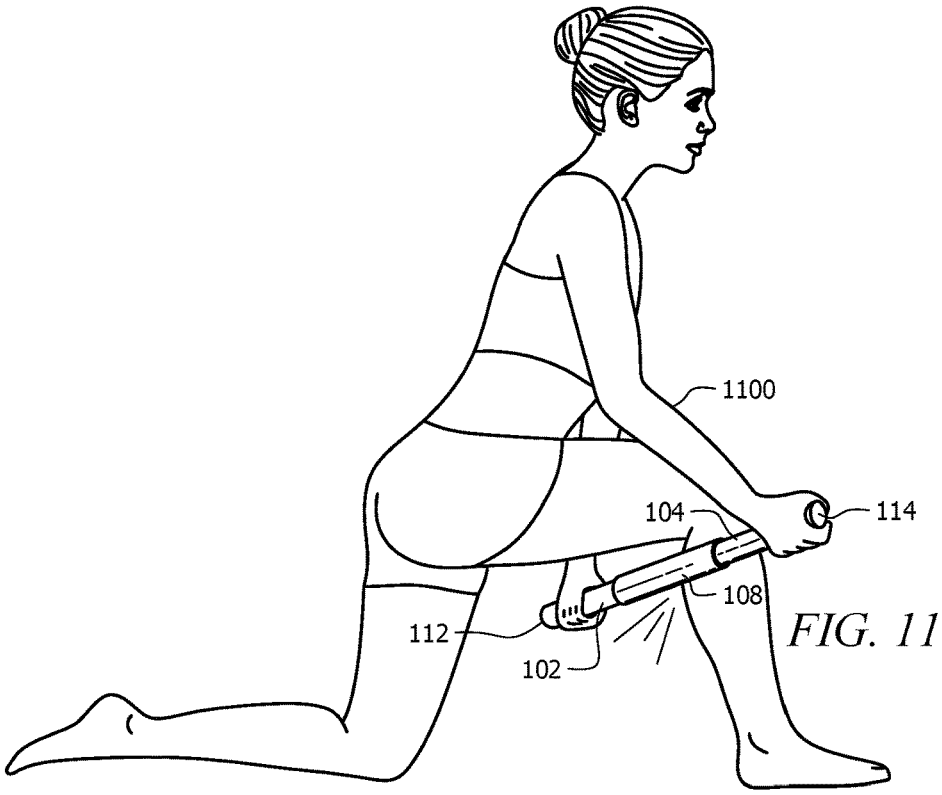
FIG. 11 depicts an embodiment of a user operating fitness apparatus in a massage bar configuration according to an illustrative embodiment.

FIG. 11 depicts user 1100 operating fitness apparatus 100 in the massage bar configuration. In particular, user 1100 grasps handles 102 and 104 and causes foam roller 108 to engage a calf muscle. The massage bar configuration of fitness apparatus 100 may be used to release tension and knots in any muscle or muscle group. Although in this illustrative embodiment, user 1100 is operating the massage bar to cause foam roller 108 to provide the massaging effects, in an alternate embodiment, user 1100 may cause the endcap affixed to one of the handles to engage a the body. The smaller point of contact permits a more focused effect.

Figure 12A:
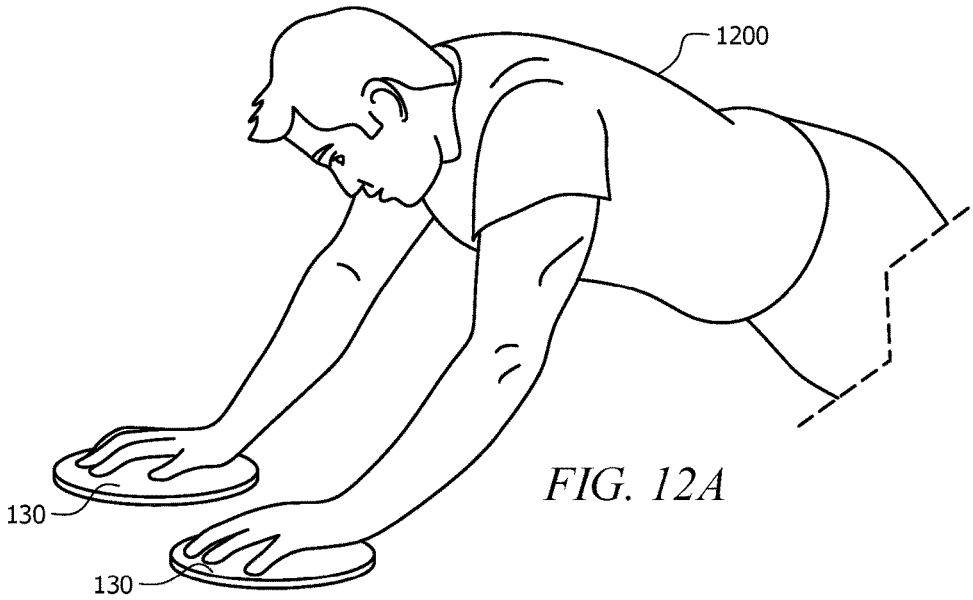
FIGS. 12*a* and 12*b* are illustrative examples of exercises that can be performed using the pair of sliders provided within a storage chamber of a fitness apparatus in accordance with an illustrative embodiment.
Figure 12B:
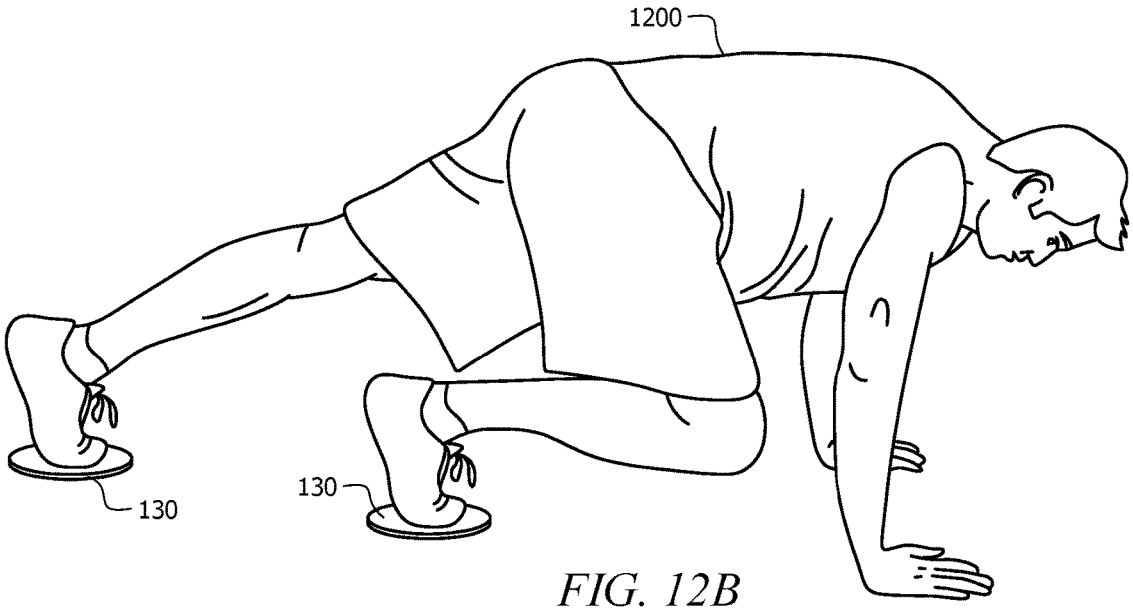

FIGS. 12*a* and 12*b* show alternative ways of exercising with the pair of sliders provided within the chamber of fitness apparatus 100. In the illustrative embodiment of FIG. 12*a*, user 1200 places one slider under the palm of each hand. The sliders reduce friction between a flooring surface, such as carpet or hardwood, and permits user 1200 to have at least two mobile points of contact, requiring exertion to produce a controlled movement. Similarly, in FIG. 12*b*, user 1200 places one slider under each foot for conducting another form of weight-based exercise.

While the invention has been particularly shown and described with reference to a preferred embodiment, it will be understood by those skilled in the art that various changes in form and detail may be made therein without departing from the spirit and scope of the invention.

What is claimed is:

1. A fitness apparatus comprising:

a wheel assembly having a first circular side, an opposing second circular side, and a curved tread surface around a circumference of the first circular side and the second circular side; wherein the first circular side, the opposing second circular side, and the curved tread surface define an enclosable storage chamber;

a centerbore passing through the wheel assembly along an axis of rotation, wherein a first end of the centerbore is a first aperture in the first circular side, and wherein a second end of the centerbore is a second aperture in the second circular side;

a spindle located within the storage chamber, wherein the spindle is concentric with the centerbore;

a shaft extending at least partially through the centerbore, wherein the shaft comprises a cylindrical roller rotatably engaged around the shaft, and wherein the wheel assembly is securely engaged around the cylindrical roller to permit the wheel assembly to rotate axially around the axis of rotation while maintaining a fixed position relative to the cylindrical roller.

2. The fitness apparatus of claim 1, wherein the enclosable storage chamber is exposable by separating the first circular side from the second circular side along a seam down a length of the curved tread surface.

3. The fitness apparatus of claim 1, wherein the shaft further comprises a first removable handle affixed to a first end of the shaft and a second removable handle affixed to a second end of the shaft.

4. The fitness apparatus of claim 3, wherein the shaft comprising the first removable handle and the second removable handle is separable from the wheel assembly to achieve a massage bar configuration.

5. The fitness apparatus of claim 3, wherein the first removable handle and the second removable handle are attached to the shaft using a quick-release mechanism.

6. The fitness apparatus of claim 5, wherein the quick release mechanism comprises a set of depressable projections and a set of corresponding anchor holes.

7. The fitness apparatus of claim 3, wherein at least one of the first removable handle or the second removable handle comprises a removable endcap.

8. The fitness apparatus of claim 7, wherein the removable endcap encloses a storage cavity within the at least one of the first removable handle or the second removable handle.

9. The fitness apparatus of claim 8, wherein the storage cavity is sized to receive at least one resistance band.

10. The fitness apparatus of claim 1, wherein the first circular side is integrally formed with a first wheel assembly component, wherein the second circular side is integrally formed with a second wheel assembly component, and wherein the first wheel assembly component and the second wheel assembly component are rotatably connected to each other.

11. The fitness apparatus of claim 1, wherein the storage chamber is shaped and sized to receive a set of resistance bands, a set of sliders, a jump rope, or combinations thereof.

12. The fitness apparatus of claim 11, wherein the jump rope comprises a set of locking discs that attach to a first removable handle and a second removable handle to achieve a jump rope configuration.

13. The fitness apparatus of claim 12, wherein the jump rope is attached to the first removable handle and the second removable handle by a quick-release mechanism.

14. A method for assembling a fitness apparatus, the method comprising:

sealing a storage chamber to form a wheel assembly;

introducing a second end of a shaft comprising a cylindrical roller rotatably engaged thereon through a centerbore of the wheel assembly, wherein the shaft comprises a first handle located at a first end;

positioning the wheel assembly substantially centrally on the cylindrical roller; and affixing a second handle to the second end of the shaft.

15. The method of claim 14, further comprising:

attaching the first handle to the first end of the shaft.

16. The method of claim 15, further comprising:

positioning the cylindrical roller on the shaft against the first handle.

17. The method of claim 14, further comprising:

winding a jump rope around a spindle within the storage chamber before sealing the storage chamber.

18. The method of claim 14 further comprising:

aligning a set of sliders within the storage chamber before sealing the storage chamber.

* * * * *